US010094204B2

(12) United States Patent
Bobylev

(10) Patent No.: US 10,094,204 B2
(45) Date of Patent: Oct. 9, 2018

(54) METHODS FOR PROCESSING PRODUCTION FORMATIONS BY HELICOID PERFORATION

(71) Applicant: LIMITED LIABILITY COMPANY "HELICOID", Moscow (RU)

(72) Inventor: Oleg Anatolevich Bobylev, Moscow (RU)

(73) Assignee: LIMITED LIABILITY COMPANY "HELICOID", Moscow (RU)

( * ) Notice: Subject to any disclaimer, the term of this patent is extended or adjusted under 35 U.S.C. 154(b) by 0 days.

(21) Appl. No.: 15/189,156

(22) Filed: Jun. 22, 2016

(65) Prior Publication Data

US 2016/0326852 A1 Nov. 10, 2016

Related U.S. Application Data

(63) Continuation of application No. PCT/RU2015/000460, filed on Jul. 17, 2015.

(30) Foreign Application Priority Data

Jul. 25, 2014 (RU) ..... 2014130917

(51) Int. Cl.

| | |
|---|---|
| ***E21B 43/114*** | (2006.01) |
| ***E21B 43/26*** | (2006.01) |
| ***E21B 47/024*** | (2006.01) |

(52) U.S. Cl.

CPC ..... *E21B 43/114* (2013.01); *E21B 43/26* (2013.01); *E21B 47/024* (2013.01)

(58) Field of Classification Search

CPC ..... E21B 43/26; E21B 43/267; E21B 43/11; E21B 43/29; E21B 43/114; E21B 47/024

See application file for complete search history.

(56) References Cited

U.S. PATENT DOCUMENTS

2007/0102156 A1* 5/2007 Nguyen et al. ..... E21B 43/267 166/280.2

* cited by examiner

*Primary Examiner* — Yong-suk Ro

(74) *Attorney, Agent, or Firm* — Arent Fox LLP; Michael Fainberg

(57) ABSTRACT

The invention belongs to the oil industry and can be used for enhanced oil recovery by formations under complicated mining and geological conditions. The method of repeated completion of the production formations by helicoid perforation includes perforation, which is performed by moving the perforator along well axis and simultaneously rotating it around its axis with making perforation channels, provided that the speeds of movement and rotation of the perforator are selected based on the condition that the perforation obtained as a result is a helicoid with creation an empty space in the processed formation.

2 Claims, 1 Drawing Sheet

METHODS FOR PROCESSING PRODUCTION FORMATIONS BY HELICOID PERFORATION

CROSS-REFERENCE TO RELATED APPLICATIONS

This application is a continuation of International Application No. PCT/RU2015/000460, now pending, which has an international filing date of Jul. 17, 2015, which in turn claims priority to Russian Federation Patent Application No. 2014130917, filed on Jul. 25, 2014, the entire contents of each of which are fully incorporated herein by reference.

TECHNICAL FIELD

The present disclosure generally relates to the oil industry and provides, among other things, methods for enhanced oil recovery from rock formations under complicated mining and geological conditions.

BACKGROUND OF THE DISCLOSURE

The most frequently used methods for repeated completion of production formations are as follows: gun-fire perforation, cumulative perforation, drilling and abrasive jet perforation, as well as hydraulic fracturing of formation (Enhancement of primary and repeated oil formations' completion quality/N. A. Petrov, V. G. Sultanov, I. N. Davydova, G. V. Konesev; under the editorship of Professor G. V. Konesev. St. Petersburg, Nedra LLC, 2007, p. 548).

Nowadays cumulative perforation is the most common because it can be quite easily implemented under any conditions. Though, this easiness in implementation does not mean the best efficiency. Thus, gun-fire perforation, cumulative perforation, drilling and abrasive jet perforation belong to point-type, i.e. completion of the formation takes place in a point (in a projection onto well wall) and to enhance connection quality it is necessary to perform multiple completion of a formation by this method.

The next level as per the quality of the completion is a kind of abrasive jet perforation—slot-type abrasive jet perforation, which performs formation completion in a plane (vertical or horizontal). This kind of formations' completion is the most gentle related to cement stone of the well and provides good connection with the formation as it allows obtaining clean channels (Development of technical support and methods of hydro-mechanical slot-type perforation process control. Author's abstract of dissertation in support for scientific degree of Candidate of Technical Sciences (Ph.D. in Technical Sciences). S. V. Nazarov, 2005). There are many variants of this kind of repeated formations' completion combining both mechanical completion of production string with blades, rollers and fully hydraulic completion of a string and cutting of filtration channel and slot. Disadvantage of this method is obtaining of well connection with formation only in one, two or three vertical planes (depending on number of nozzles).

Currently the method of repeated formation completion allowing obtaining maximal hydrodynamic connection between the formation and the well is hydraulic fracturing of formation (see e.g., RU 2485296). This technology became very commonly used due to its high efficiency, but it, as well as slot-type abrasive jet perforation, makes formation completion plane directional (vertical or horizontal). Also this technology has limitations of applicability under complicated mining and geological conditions (presence of gas caps or active bottom waters), as the crack of hydraulic fracturing has long vertical length and can extend beyond the production formation. Thus, the main disadvantage of this technology is essential availability of thick aquicludes (e.g., aquifuges) in the well between the production formation and other water or gas-bearing formations, which would prevent fracturing cracks from propagating to other formations.

The technology of slot hydraulic formation cutting was taken as the basis for implementation of the technology of hydrodynamic connection quality maximization, as this technology allows working under complicated mining and geological conditions and has the potential for improvement.

There is great variety of slot forming methods lately existing in this field, but almost all of them are limited to cutting vertical slots either under continuous mode (see. e.g., RU Patent 2282714), or under periodic mode with joining the slots in formation (see e.g., RU Patent 2365742).

The methods of production formations' completion by slot perforation are also widely known (see, e.g., RU Patent 2397317), when the perforator runs into the well down to the given depth with the subsequent moving of the perforator upwards and cutting a slot in the wall of the casing string/production string with removable disc cutter. Perforation is done in the well section by slot-type areas located relative to each other with a preset pitch along the spiral line around the axis of a string.

Making a slot on each area is done by moving the cutter axis in the plane of slot making as per the preset trajectory with simultaneous reciprocating movement of the perforator in vertical direction relative to casing string. The speed of perforator movement is selected based on design conditions of the production formation completion. Disadvantages of this method include the limitation of perforation height and depth by the length of disc cutter travel.

RU Patent 2393341 titled "Hydro-mechanical Slot Perforator" discloses a method for volumetric well perforation and proposes to install threading rollers of the perforator at an angle to the vertical axis for obtaining screw slots. The purpose of this method was creation of such slots that allow the casing string to withstand horizontal rock constituent to prevent the string from crushing. Eventually, the patent discloses that the device allows well equipping with the system of extended crosswise channels. However, the disclosed methods have multiple disadvantages, including availability of channels; specifically slots' creation instead of thorough removal of the mine rocks in the area of contact, i.e., formation completion takes place along the helicoid surface and in an involute it is a planar variant, which leads to appearance of additional filtration resistances during filtration of the fluids from the formation into the well.

SUMMARY OF THE DISCLOSURE

One of the problems solved by the methods disclosed herein is the creation of maximal possible size channel for filtration of formation fluids into the well.

Selected aspects of the present disclosure provide several advantages compared to methods known in the art, including the creation of a well open bottom-hole (cavity) of radius over 0.5 m, decreasing of filtration resistances, decreasing of "shutdown" risk degree during hydraulic fracturing of formation and increasing filtration efficiency.

The specified technical result is achieved due to the fact that the perforation is performed by moving the perforator along the well axis and simultaneously rotating it around its axis with creation of perforation channels, provided that the speeds of perforator movement and rotation are selected based on the condition that the perforation achieved as a result shall be helicoid with the creation of an empty space in the processed formation, in this case a hydraulic perforating cap (hydraulic perforator) is used as a perforator, and the pitch of the obtained helicoid is 10 cm, wherein pitch of the helicoid is 0.7 of maximal slot height. Perforation channels are joined with each other in the formation due to small pitch of the helicoid and cylindrical mine working of radius over 0.5 m is created in casing string annulus. The area of fluid filtration from the formation into the well is 5 times more than for open well bore, which leads to decreasing skin factor to the level of hydraulic fracturing of formation without destroying formation top or bottom or bridging inside the formation.

DETAILED DESCRIPTION OF THE DISCLOSURE

Figure 1:
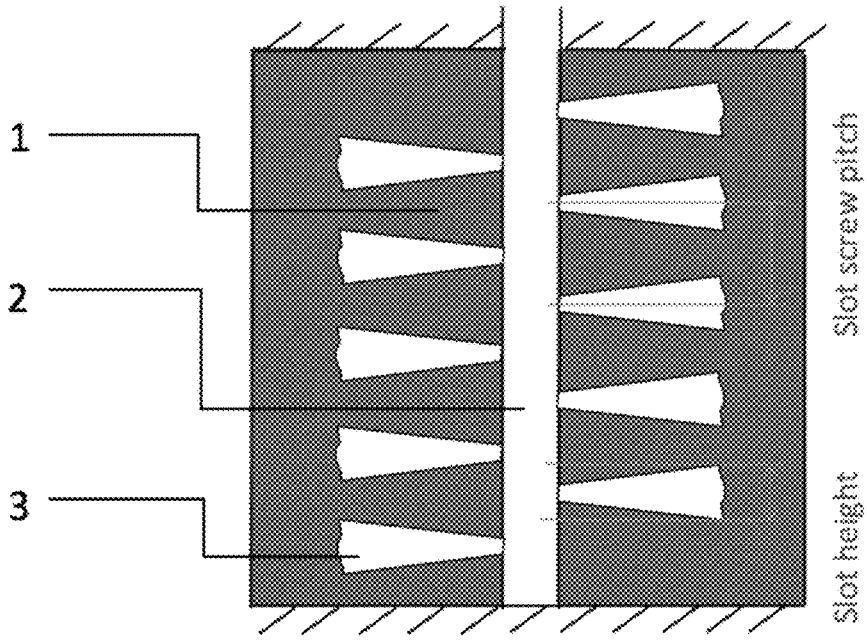
FIG. 1 illustrates a cross-section view of well bottom-hole zone in case of cutting separate screw slots/perforation channels (screw pitch>slot height)

Helicoid perforation allows formation completion to the whole volume, and not just in a point (cumulative, hydraulic perforation) or in a plane (slot perforation, hydraulic fracturing of formation). Helicoid perforation includes hydraulic perforator (hydraulic perforating cap) and a mechanism with the possibility to move the perforator along well axis and also rotate it. Rotation and movement of the hydraulic perforator along the axis can be done by three possible methods: hydraulic, mechanical and mechanical-hydraulic.

(1) Hydraulic method. There is the equipment allowing lifting bottom-hole hydraulic perforator using the downhole device for vertical movements of hydraulic perforator (RU Patent 2175378). Combining the downhole device for lifting the perforator with the drive for rotation—VG-1 (Russian: ВГ-1) downhole rotator (Temporary instruction for abrasive jet perforation and formation completion. Moscow, 1967, All-Union Scientific Research Institute, p. 5, p. 33), allows the nozzle of the hydraulic perforator to outline the helicoid and perform the perforation of the required configuration. To control the helicoid pitch a slide valve device is installed between two devices, which needs to be regulated for each specific case. Disadvantage of the hydraulic method is the complexity of the helicoid pitch value control, as it depends on differential pressure, which can be changed significantly in the process of mine rocks cutting, and the installed slide valve device allows obtaining average pitch value.

(2) Mechanical method. There is the equipment for performing screw slot-type hydraulic perforation combined with the function of casing string metal cutting with hard threading rollers. Disadvantage of the specified equipment is making slots instead of complete removal of mine rocks in the area of contact. Solution of this problem is precise calculation of the perforator screw pitch aimed at closure of the threaded slots to create volumetric cavity.

(3) Mechanical-hydraulic method. It is a combination of two abovementioned methods. Using this method will provide the preset helicoid pitch (installation of threading rollers at the specified angle to the axis) and maximum operation pressure of fluid jet (air-tight wellhead).

In the first variant the feature of novelty is combination of two assemblies and installation between them of additional throttle, which is regulated for certain parameters of cutting, providing the required trajectory of the hydraulic perforating cap movement under the preset differential pressure.

In the second variant the feature of novelty is installation of threading rollers at the design angle to the well axis, providing the required trajectory of the hydraulic perforating cap (hydraulic perforator) movement during movement of flow string up and down allowing joining the threaded perforation channels (slots) into joint cavity.

In the third variant the feature of novelty is also installation of threading rollers at the design angle to the well axis, providing the required trajectory of the hydraulic perforating cap movement during progressive motion generated by downhole device for vertical movements.

Figure 2:
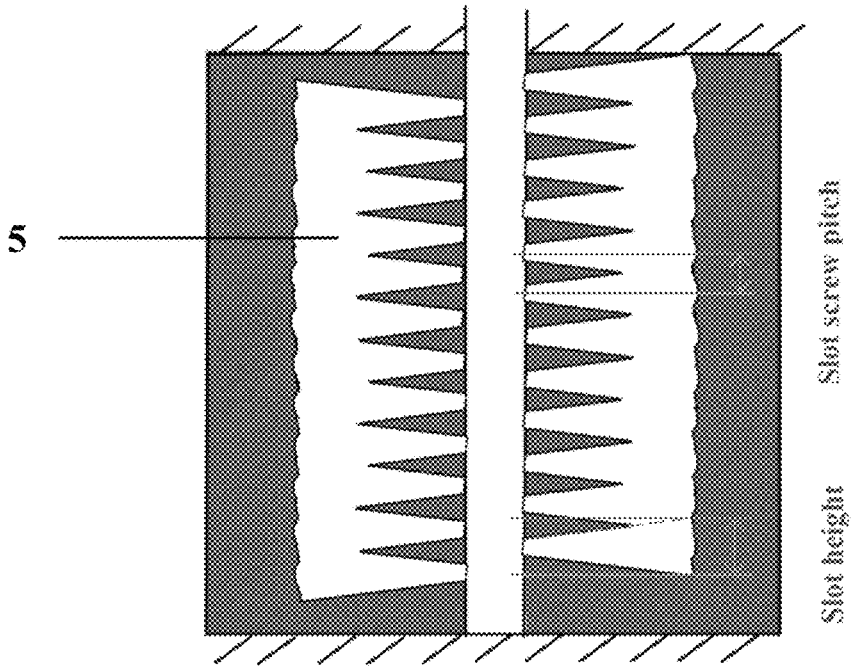
FIG. 2 illustrates a cross-section view of well bottom-hole zone in case of cutting joint screw slots/perforation channels into joint empty space (screw pitch>0.7 slot height).

The preset pitch of hydraulic perforating cap helicoidal movement is required for creation of empty space. Thus, on FIG. 1 the variant of empty space is given obtained in case (4), when the helicoid pitch exceeds maximum width of the threaded slot (perforation channel) (3), in this case the perforation channels are not close between themselves. In case of helicoid pitch decreasing (FIG. 2) and achieving its value of maximum width of the threaded slot, closing of the threaded slots takes place in the points of maximum width. To achieve stable joining of the obtained cavities it was proposed to decrease helicoid pitch to 0.7 of maximum slot height, which allows obtaining joint empty space (5) (FIG. 2) in the processed formation (1) (FIG. 1) (production formation), providing maximal inflow of the fluid from the formation into the well. The depth of such empty space will depend on mechanical properties of the mine rock, geometric parameters of the hydraulic perforator, physical properties of perforation fluid and the used abrasive material, as well as the created differential pressure in the hydraulic perforator. It should be noted that during creation of such empty space its depth will be more than for slot cutting and for hydraulic perforation, because the operation jet will almost not be killed by backward jet of the fluid.

Exemplary Aspects of the Disclosure

For creation of the empty space in the well the following operations shall be performed. According to the first variant a slide valve device shall be installed between two devices: downhole device for vertical movement of the perforator and downhole rotator. The assembled equipment will be run down to the specified section of the processed formation on flow string. In the specified section during fluid supply to flow string under high pressure the first device will start lifting hydraulic perforator with the preset speed, which is ensured by differential pressure. The fluid in the flow string via slide valve device will be supplied to the second device under the preset pressure (lower than in the first device), which will ensure its rotation and transmit this rotation to the hydraulic perforator. After that the fluid will be supplied to the hydraulic perforator and running via its nozzle (or nozzles) will achieve high kinetic energy, which will be used for destroying casing string and the processed formation and thus wash in a cavity (empty space or as it also called open cavity). Due to the fact that the hydraulic perforator is lifted and rotates simultaneously the outgoing jet outlines a helicoid and performs cutting not just in one plane, but volumetrically (in three axes). As the dimension of slide valve device is calculated as per the specific formulae to provide quantitative relation of progressive and rotational motion to the size of the distance between the threaded slots (helicoid pitch) 10 cm (70% of 15 cm of average proved width of abrasive jet slot), the open cavity will be created in the well to the height of the perforator lifting with the depth preset by the parameters of perforator, mechanical properties of mine rock and differential pressure. When the perforator lifting using downhole device for vertical movement is over, it is necessary to perform lifting of the whole assembly for recharging.

According to the second variant installation of the threading rollers is performed for double hydraulic-mechanical slot perforator at the angle ensuring the distance between the threaded slots of the hydraulic perforator 10 cm. The angle calculation is done using the formula:

$$\varphi = \tan^{-1}\frac{\pi \cdot D}{T \cdot n},$$

where φ is the angle of rollers' inclination to the axis, degree;

D—inner diameter of production string, m;

T—the required helicoid pitch, m;

n—number of perforator screw entries (1, 2 or 3).

Thus, for production string with inner diameter 146 mm for obtaining pitch 10 cm for one entry perforator (1 cap) the angle will be 77.7°, for two entry perforator (2 caps)—66.4° and for three entry perforator (3 caps)—56.8°.

Running of perforator down to the preset depth is performed; in this case wellhead is equipped with stuffing box ensuring vertical lifting of flow string. After perforator running down, working fluid is supplied to flow string under pressure due to this fact the rollers come out of their slots and perform destroying production string metal in the point of contact. At the same time destroying of cement stone and formation rock takes place due to kinetic energy of working fluid jet. At the initial moment of start-up the pressure on wellhead equipment increases rapidly, but at the progress of cavity cutting the pressure drops and stabilizes. After pressure stabilization the stage of flow string lifting begins, which leads to rotation of hydraulic perforator, as the rollers installed at the angle to the well axis transform the progressive motion into rotation-progressive. At this moment cutting of screw slot in the formation begins. Fluid pressure increasing on wellhead equipment takes place. After the second turn of the slot will be cut closure of the second turn cavity with the cavity of the first turn will take place and joint mine working will be created, which will be reflected as pressure drop on wellhead equipment. As the slot perforator has two jet nozzles, this effect will be observed during flow string lifting to the height 10/2=5 cm. After that the stage of further cavity cutting to the design value will start. The advantage of this method if compared to the first method is the possibility of the precise regulation of flow string lifting speed, as well as the perforator, which as a result is reflected on parameters achieving as per the depth of the obtained cavity. Also the advantage of this method is the possibility of cavity obtaining not limited by the height, as there is no need in lifting the assembly for recharging as in the first method. The height of the obtained cavity can be limited by the time of continuous operation of jet nozzles due to their abrasive wearing by the jet of working fluid.

The third method of open cavity obtaining, as it was already noted, is the combination of two aforesaid. The equipment assembly of downhole device for vertical movement and hydraulic perforator with threading rollers is run down to bottom-hole. After perforator running down, working fluid is supplied to flow string under pressure due to this fact the rollers come out from the slots and perform destroying production string metal in the point of contact. At the same time destroying of cement stone and formation rock takes place due to kinetic energy of working fluid jet.

Also due to differential pressure between flow string and in tubular annulus downhole device for vertical movement starts lifting hydraulic perforator and it will rotate due to threading rollers installed at the angle. As a result cutting screw slot (helicoid) takes place as per the preset trajectory with creation of empty space in the formation without destroying perforation channels. The advantage of this method is the possibility of high differential pressure creation and as a result creation of deep slots and greater empty space.

The invention claimed is:

1. A method of repeated completion of pay formations, including running a hydraulic perforator down the well;

regulating a speed of motion of the hydraulic perforator to a predetermined speed;

regulating an angle of threading rollers of the hydraulic perforator;

moving the hydraulic perforator down along an axis of the well to perform perforation of the production string; and rotating, simultaneously with the moving, the hydraulic perforator around the axis of the well to perform cutting of threaded slots into the well, wherein the predetermined speed and the angle are pre-set to cut the threaded slots as helicoid-like slots with a pitch of 0.7 of maximal height of the threaded slots and assure closing of the threaded slots into joint empty space of mine working.

2. The method of claim 1, wherein perforation of the threaded slot is performed with the pitch of 10 cm.

* * * * *